US006452575B1

(12) United States Patent
Lin

(10) Patent No.: US 6,452,575 B1
(45) Date of Patent: Sep. 17, 2002

(54) PLANAR RECIPROCATING ELECTRONIC LIGHT EMITTING DEVICE

(76) Inventor: Ching-Sui Lin, 8F, No. 14, Alley 5, Lane 88, Datung Rd., Sanshia cheng, Taipei Hsien (TW)

( * ) Notice: Subject to any disclaimer, the term of this patent is extended or adjusted under 35 U.S.C. 154(b) by 160 days.

(21) Appl. No.: 09/688,034

(22) Filed: Oct. 12, 2000

(30) Foreign Application Priority Data

Mar. 1, 2000 (TW) ..... 089203217

(51) Int. Cl.[7] ..... G09G 3/00; G09G 3/34

(52) U.S. Cl. ..... 345/31; 345/30; 345/108; 345/110

(58) Field of Search ..... 345/31, 30, 44, 345/46, 108, 110

(56) References Cited

U.S. PATENT DOCUMENTS

| | | | | |
|---|---|---|---|---|
| 5,041,947 A | * | 8/1991 | Yuen et al. | 362/35 |
| 5,202,675 A | * | 4/1993 | Tokimoto et al. | 340/782 |
| 6,265,984 B1 | * | 7/2001 | Molinaroli | 340/815.4 |
| 6,278,419 B1 | * | 8/2001 | Malkin | 345/31 |
| 6,348,905 B1 | * | 2/2002 | Wang | 345/31 |

* cited by examiner

*Primary Examiner*—Bipin Shalwala
*Assistant Examiner*—Jimmy H. Nguyen
(74) *Attorney, Agent, or Firm*—Bacon & Thomas, PLLC

(57) ABSTRACT

Disclosed is a planar reciprocating electronic light emitting device consisting of a small amount of light emitting units arrayed in a row or more than one row transversely which being able to reciprocate up and down so as to exhibit much better visual effect than a large scaled displaying device thereby reducing fault rate and production cost, and increasing production efficiency.

8 Claims, 4 Drawing Sheets

PLANAR RECIPROCATING ELECTRONIC LIGHT EMITTING DEVICE

BACKGROUND OF THE INVENTION

1. Field of the Invention

This invention relates to a planar reciprocating electronic light emitting device, and more particularly, to an electronic light emitting device consisting of a small amount of light emitting units arrayed in a row or more than one row which being able to reciprocate so as to exhibit much better visual effect than a large scaled displaying device thereby reducing fault rate and production cost of the displaying device.

2. Description of the Prior Art

A conventional planar electronic displaying device is composed of a group of single light emitting units disposed orderly to form a collective body. It usually requires a large numbers of single light emitting units. If the display density of an electronic displaying device is 48 spots in height and 160 spots in width, the amount of total light emitting units will be 48×160=7680 units. If only one among this group of light emitting units is out of order, the whole operating effect of the device will be severely degraded. As a result, users have to tolerate the disadvantages of high fault rate and expensive maintenance cost of the conventional products.

Being encouraged by an intention to eliminate the disadvantages inherent to the conventional technique as mentioned above. The present inventor has devoted to resolve these disadvantages with a long time efforts in research and simulation, and finally came to realization of this invention.

SUMMARY OF THE INVENTION

Accordingly, it is an object of this invention to provide a planar reciprocating electronic light emitting device consisting of a small amount of light emitting units arrayed in a row, or more than one row which being able to reciprocate on the screen so as to exhibit even much better effect than a conventional large scaled displaying device thereby reducing fault rate and production cost, and increasing, production efficiency.

For comparison, 48×160=7680 light emitting units are employed in a conventional device, whereas only 160 (one row ) units are required for this invention to achieve an equivalent effect. As shown in FIG. 1, in this invention, a group of light emitting units 1 is horizontally arrayed in a row on a planar reciprocating body 2, then the reciprocating body 2 is moved up and down vertically with the aid of nature of persistence of vision inherent to human eyes, letters of figures may be seen on the screen. The frequency of reciprocation is approximately 12 cps which means the light emitting units 1 scans the same spot on the plan 24 times/sec.

Next,e how the reciprocating body 2 can make a rapid swing motion on the plan will now be explained as follows with reference to FIG. 2. As shown in FIG. 2 the diameter of a big circle $\theta_1$ is formed twice as large as that of a small circle $\theta_2$ As the small circle $\theta_2$ is rolled along inner circumference of the big circle $\theta_1$ in clockwise direction, it will be found that point A on the small circle $\theta_2$ will reciprocate along a line connecting points B and C. Next, referring to FIG. 3, assuming that the reciprocating body 2 is fixed on point A when the small circle $\theta_2$ rolls along the inner circumference of the big circle $\theta_1$ in clockwise direction one round, the reciprocating body 2 is also able to reciprocate along the line connecting points B and C, and at the same time, the reciprocating body 2 makes one revolution in counter clockwise direction. In this case if point A is made to be able to revolve in clockwise direction with relative to the small circle $\theta_2$ then as the small circle $\theta_2$ rolls one round in clockwise direction in the manner described above, point A also makes one revolution in clockwise direction with relative to the small circle $\theta_2$. In the case the small circle $\theta_2$ continuously keeps rolling, the reciprocating body 2 also keeps continuous reciprocating motion between line B C and maintains the original pose facing to a constant direction. If the light emitting units 1 are disposed thereon and flicker at a relevant time interval, desired letter or pictures can be displayed on the screen.

BRIEF DESCRIPTION OF THE DRAWINGS

For fuller understanding of the nature and objects of the invention, reference should be made to the following detailed descriptions taken in conjunction with the accompanying drawings in which.

DETAILED DESCRIPTION OF THE PREFERRED EMBODIMENT

Figure 4:
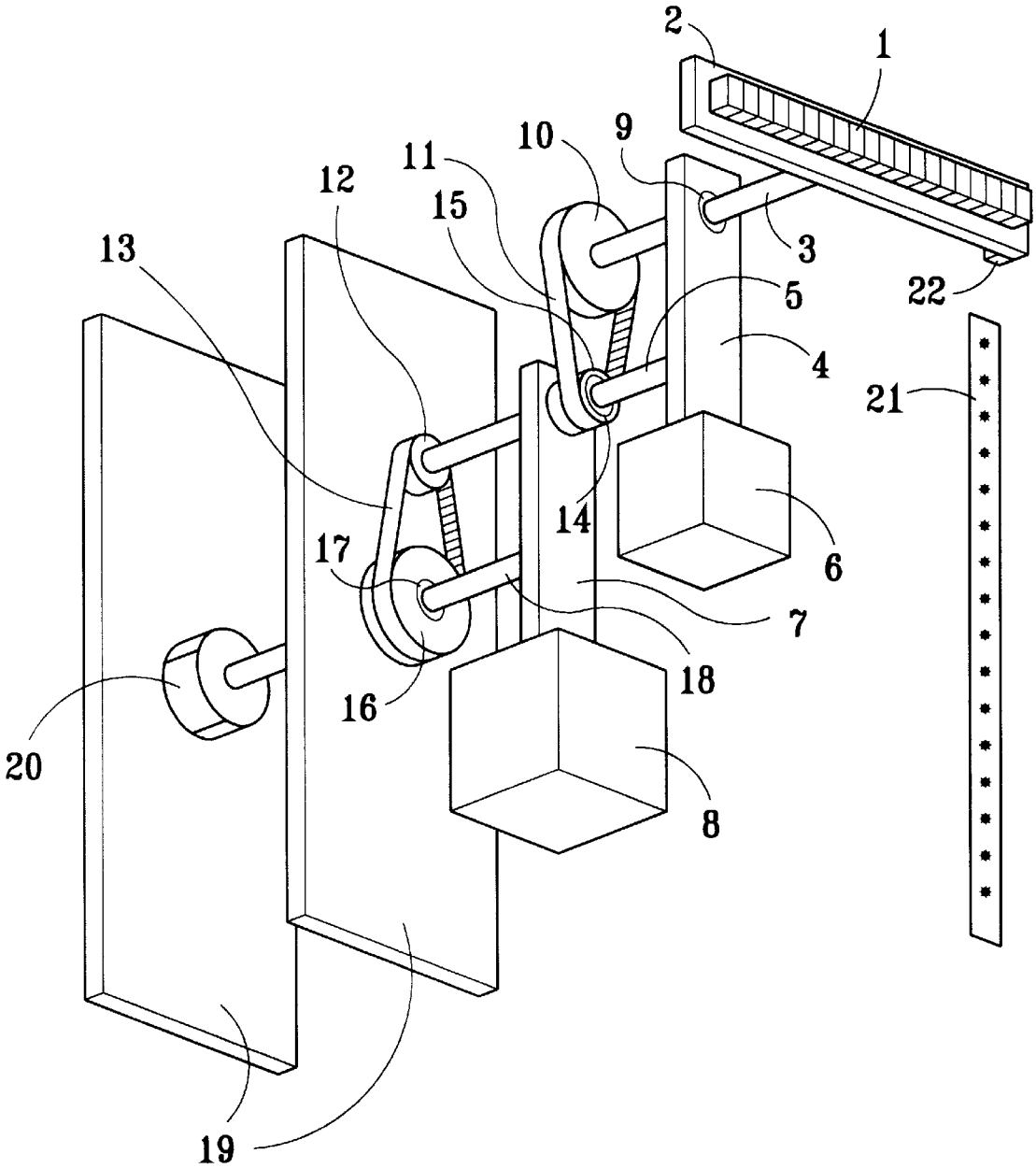
FIG. 4 is a three dimensional perspective view of this invention.

Referring to FIG. 4, a plurality of light emitting units 1 consisted in this invention are arrayed transversely in one or more than one row, with equal or unequal distance, on a long strip shaped planar reciprocating body 2 engaged to a second timing pulley of driving shaft 10 via a rotating shaft 3. The second timing pulley of driving shaft 10 is combined to a timing pulley of attaching rod 15 via a timing belt 11. The timing pulley of attaching rod 15 is attached to a first revolving rod 7. A second revolving rod 4 is pierced by the rotating shaft 3 interconnecting the reciprocating body 2 and the second timing pulley of driving shaft 10. The second revolving rod 4 is conjoined to a first timing pulley of driving shaft 12 with a rotating shaft 5 piercing through the timing pulley of attaching rod 15 and the first revolving rod 7. The first timing pulley of driving shaft 12 is further combined with a timing pulley of attaching framework 16 by way of the timing belt 13. The timing pulley of attaching framework 16 is fixed to a framework 19 in which a motor 20 is accommodated. The motor 20 is engaged to the first revolving rod 7 with its rotating shaft 18 piercing through the framework 19 and the timing pulley of attaching framework 16.

With this structure, the timing pulley of attaching framework 16 and the framework 19 are fixedly attached with each other, and the timing pulley of attaching rod 15 and the first revolving rod 7 are also fixedly attached with each other. The gear tooth ratio between the second timing pulley of driving shaft 10 and the timing pulley of attaching rod 15 is 2:1, and the gear tooth ratio between the timing pulley of attaching framework 16 and the first timing pulley of driving shaft 12 is also 2:1.

Figure 5:
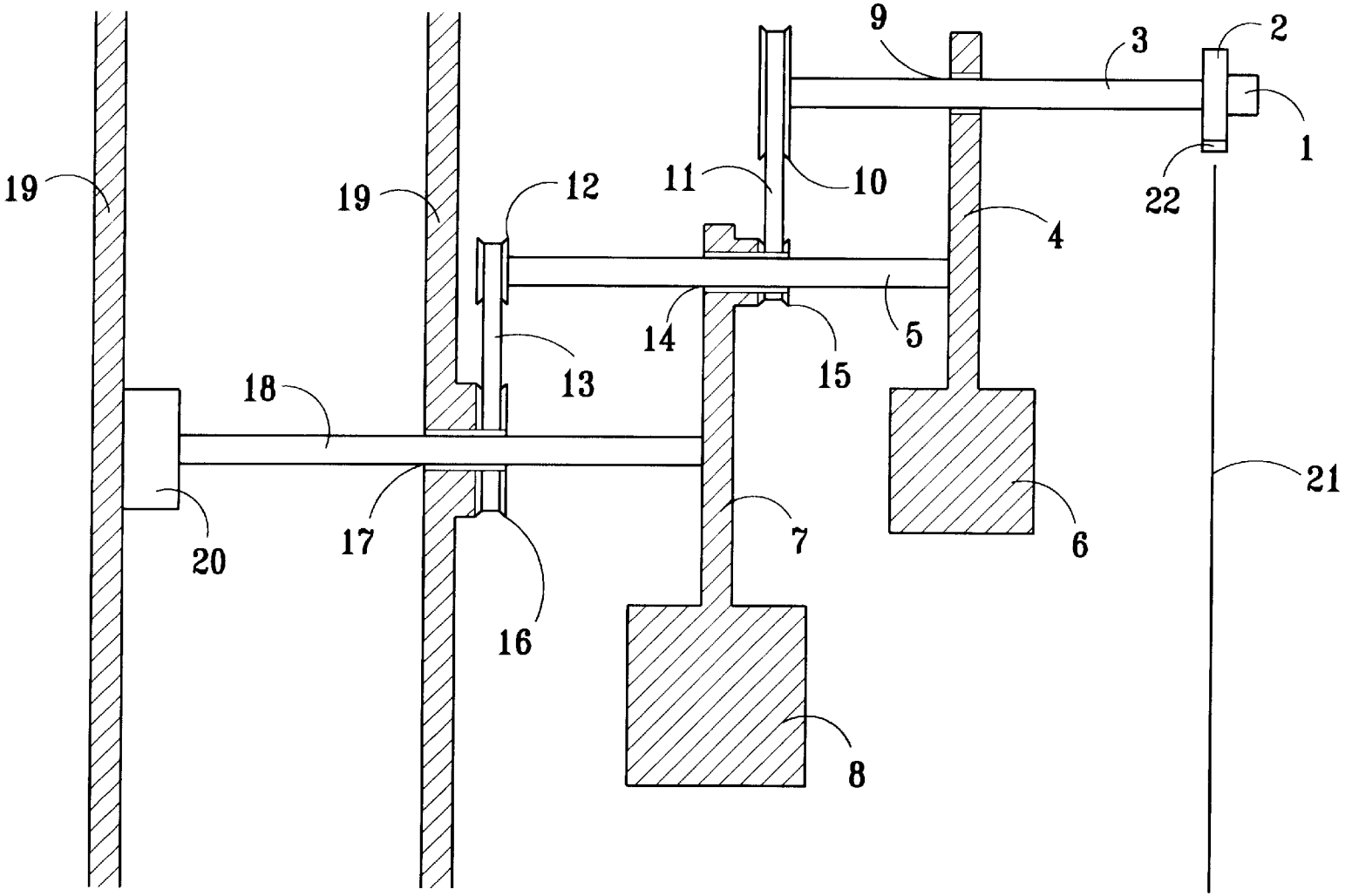
FIG. 5 is a side cross sectional view of this invention.
Figure 6:
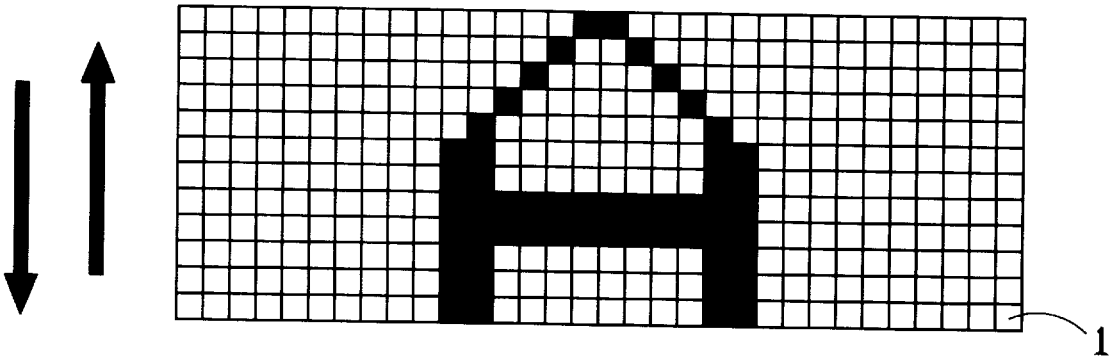
FIG. 6 is a schematic drawing demonstrating the displaying effect of this invention.

Referring to FIG. 5, this is a side cross sectional view of this invention. As shown in FIG. 5, the rotating shaft 5 and the rotating shaft 3 are respectively equivalent to center of the small circle $\theta_2$ and point A on the circumference of the small circle $\theta_2$, and the reciprocating body 2 is located at point A. With such a scheme when the motor 20 rotates, the rotating shaft 18 follows and drives the first revolving rod 7 to turn. The first timing pulley of driving shaft 12 then begins to operate and drive the rotating shaft 5 and the second revolving rod 4, and at the same time drivels the rotating shaft 3 to rotate and the reciprocating body 2 to move up and down. The second revolving rod 4 encircles along circular locus formed by the rotating shaft 5. This state is equivalent to the small circle $\theta_2$ rolls along the circumference of the big circle $\theta_1$ shown in FIG. 3. With the aid of the timing belt 11, the second timing pulley of driving shaft 10 and the timing pulley of attaching rod 15 drive the reciprocating body 2 to turn with relative to the second revolving rod 4 through rotating shaft 3. This state is equivalent to point A of FIG. 3 being able to revolve. A bearing 9 is provided at the location where the rotating shaft 3 pierces through the second revolving rod 4. Meanwhile, a bearing 14 is provided at the location where the rotating shaft 5 pierces through the position corresponding to the attached position of the first revolving rod 7 to the timing pulley of attaching rod 15. A bearing 17 is also provided at the location where the rotating shaft 18 pierces through the position corresponding to that the timing pulley of attaching framework 16 is mounted on the framework 19. By means of providing the bearings 9, 14, 17, a high speed revolution of this invention is therefore achieved.

Returning to FIG. 4, when the motor 20 rotates in clockwise direction, the first revolving rod 7 also revolves in clockwise direction which causes the second revolving rod 4 to roll along in clockwise direction while itself revolves in counter clockwise direction. As a result, the rotating shaft 3 and the reciprocating body 2 revolve in clockwise direction with relative to the second revolving rod 4.

Figure 3:
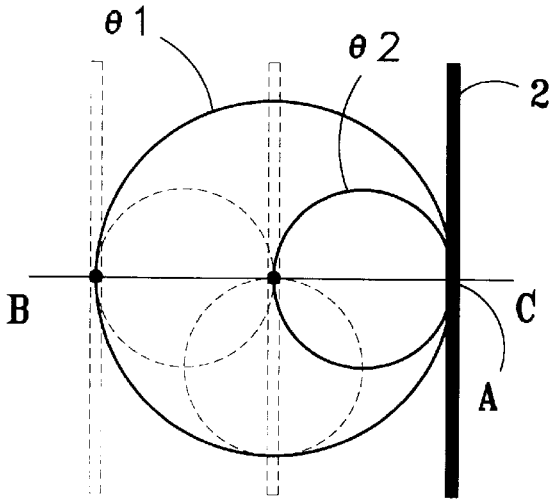
FIG. 3 is still another explanatory drawing for illustration of operational principle of this invention.

The distance between the rotating shaft 18 and the rotating shaft 5 is equal to the distance between the rotating shaft 5 and the rotating shaft 3. Therefore, when the motor 20 operates, the reciprocating locus of the rotating shaft 3 is a straight line coincides with the straight line connected between point B and point C on which the point A reciprocates as shown in FIG. 3.

Being, influenced by the motion of the rotating shaft 3; the second timing pulley of driving shaft 10; the timing belt 11; and the timing pulley of attaching rod 15, the reciprocating body 2 makes a vertical reciprocating motion on a plan and constantly faces to a fixed direction. In addition, the first revolving rod 7 is provided with a balancer 8 at the other location from the place where the rotating shaft 5 pierces through, and similarly, the second revolving rod 4 is provided with a balancer 6 at the other location from the place where the rotating shaft 3 pierces through. Both balancers 8 and 6 are for balancing high speed motion of the two revolving rods 7 and 4 respectively.

Figure 1:
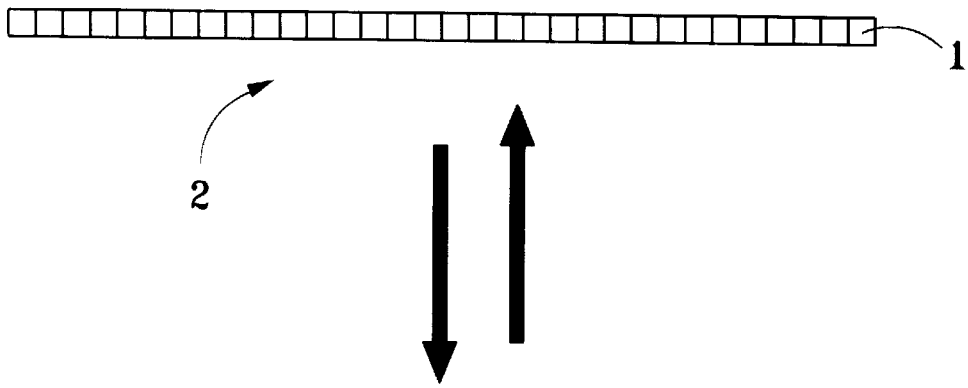
FIG. 1 is an explanatory drawing for illustration of operational principle of this invention.
Figure 2:
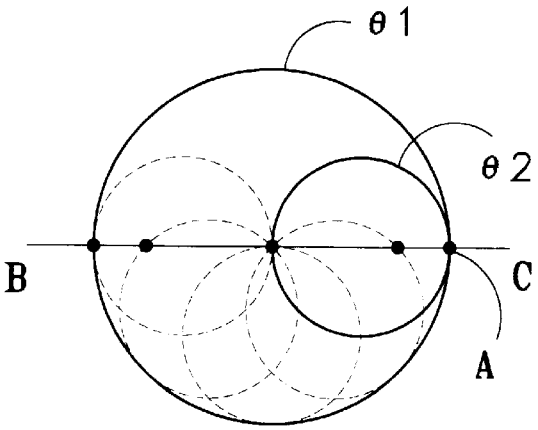
FIG. 2 is another explanatory drawing for illustration of operational principle of this invention.

In the case motor 20 is rotated in counter clockwise direction, the first revolving rod 7 also revolves in counter clockwise direction which causes the second revolving rod 4 to roll along in counter clockwise direction while itself revolves in clockwise direction. Consequently, the rotating shaft 3 is still able to keep reciprocating on a straight line so that the reciprocating body 2 swings up and down on a plan as shown in FIG. 1.

Referring to FIGS. 4 and 5 simultaneously, a photo detector 22 is installed at a proper location on the reciprocating body 2 and a position device 21 is provided at the vertical moving zone of the reciprocating body 2. When the reciprocating body 2 reciprocates in a plan, the photo detector 22 is able to detect the instant location of the reciprocating body 2 through the position device 21 and an associated electronic control circuit thereof so as turn on or turn off corresponding light emitting units 1. By reciprocating the light emitting units 1 12 times/sec, i.e. scanning the same spot 24 times/sec, specific letters or pictures can be observed on the display screen by human persistence of vision.

Figure 7:
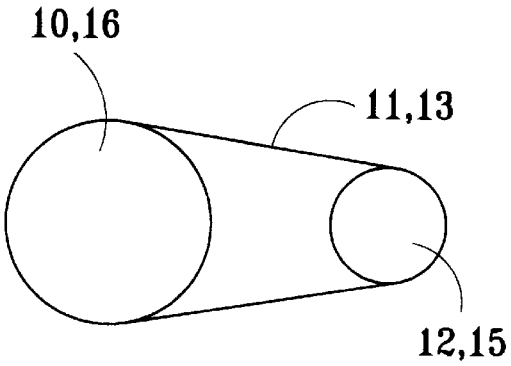
FIG. 7 is an explanatory drawing for illustration of operational principle of the timing belt according to this invention.
Figure 8:
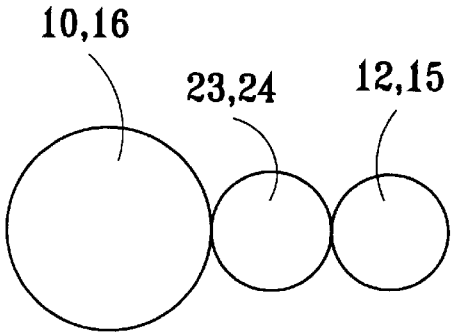
FIG. 8 is an explanatory drawing for illustration of gear transmission principle according to this invention.

Referring to FIG. 7, in this invention, the second timing pulley of driving shaft 10 is combined with the timing pulley of attaching rod 15 through the timing belt 1; and the first timing pulley of driving shaft 12 is combined with the timing pulley of attaching framework 16 through the timing belt 13. Alternatively, as shown in FIG. 8, a gear 23, 24 can be used instead of the two timing belts 11 and 13 if it is considered more convenient.

For a comparatively longer reciprocating body 2, this invention is able to provide more than one set of above described driving mechanism to be attached to proper positions of the reciprocating body 2 for achieving a broader display effect.

Incidentally, the light emitting units 1 may be mixed with various colored units such as three primary colors red, green and blue units for exhibiting more colorful effect.

In summary, it is obvious that this invention is able to exhibit even much better effect than a conventional large scaled displaying device with a planar reciprocating electronic light emitting device consisting only a small amount of light emitting units arrayed in a row, or more than one row so as to reduce fault rate and production cost, and increase production efficiency.

While this invention has been particularly shown and described with reference to a particular embodiment thereof, it will be understood by those skilled in the art that various changes in form and detail may be effected therein without departing from the spirit and scope of the invention as defined by the appended claims.

What is claimed is:

1. A planar reciprocating electronic light emitting device comprising;

a reciprocating body 2 with a row or more than one row of light emitting units 1 being arrayed transversely in equal or unequal distance thereon;

a second timing pulley of driving shaft 10 conjoined and engaged to said reciprocating body 2 by a rotating shaft 3, said second timing pulley of driving shaft 10 further combined with a timing pulley of attaching rod 15 through a timing belt 11, said timing pulley of attaching rod 15 being conjoined and engaged to a first revolving rod 7;

a first timing pulley of driving shaft 12 being conjoined and engaged to a second revolving rod 4 with a rotating shaft 5 piercing through said first revolving rod 7 and said timing pulley of attaching rod 15, and one end of said second revolving rod 4 is pierced by said rotating shaft 3 interposed between said reciprocating body 2 and said second timing pulley of driving shaft 10, said first timing pulley of driving shaft 12 being combined to a timing pulley of attaching framework 16 via a timing belt 13, while said timing pulley of attaching framework 16 being engaged to a framework 19; and said framework 19 accommodates a motor 20 therein which having one direct or indirect rotating shaft 18 piercing through said framework 19 and said timing pulley of attaching framework 16, and then conjoined with said first revolving rod 7.

2. The light emitting device of claim 1, wherein said timing pulley of attaching framework 16 and said framework 19 are statically engaged together, while said first timing pulley of driving shaft 12 is driven to rotate by said timing belt 13 which further drives said rotating shaft 5 and said second revolving rod 4; while being engaged to said first revolving rod 7, said timing pulley of attaching rod 15 remains stationary with relative to said first revolving rod 7, said second timing pulley of driving shaft 10 is driven to rotate by said timing belt 11 which further drives said rotating shaft 3 and said reciprocating body 2 such that said motor 20 is able to drive said rotating shaft 18 and said first revolving rod 7, and further drives said second revolving rod 4 and said reciprocating body 2 to operate.

3. The light emitting device of claim 1, wherein the tooth ratio of said second timing pulley of driving shaft 10 to said timing pulley of attaching rod 15 is 2:1, similarly, the tooth ratio of said timing pulley of attaching framework 16 to said first timing pulley of driving shaft 12 is also 2:1.

4. The light emitting device of claim 1, wherein transmission of rotative motion between said second timing pulley of driving shaft 10 and said timing pulley of attaching rod 15, and between said first timing pulley of driving shaft 12 and said timing pulley of attaching framework 16 can be carried out by gears and machine method instead of depending on timing belts and timing pulleys.

5. The light emitting device of claim 1, wherein the distance between said rotating shaft 18 and said rotating shaft 5 is equal to the distance between said rotating shaft 3 and said rotating shaft 5, in addition, said first revolving rod 7 is provided with a balancer 8 at the other location from the place where said rotating shaft 5 pierces through, and similarly, said second revolving rod 4 is provided with a balancer 6 at the other location from the place where said rotating shaft 3 pierces through, said two arbitrarily shaped balancers 6 and 8 are for balancing high speed motion of said two revolving rods 7 and 4.

6. The light emitting device of claim 1, wherein if said reciprocating body 2 is considerably long, more than one set of said driving mechanism can be provided to drive said reciprocating body 2 for achieving a broader display effect.

7. The light emitting device of claim 1, wherein a photo detector 22 is installed at a proper location on said reciprocating body 2, and a position device 21 is provided at the vertical moving zone of said reciprocating body 2 for detecting the instant location of said reciprocating body 2.

8. The light emitting device of claim 1, wherein said light emitting units 1 can be mixed with various colored units such as three primary colors red, green and blue units for exhibiting more colorful effect.

* * * * *